United States Patent [19]

Ruff

[11] Patent Number: 4,749,140

[45] Date of Patent: Jun. 7, 1988

[54] WINDING MACHINE FOR WINDING A WEB SLIT LENGTHWISE

[75] Inventor: Hans-Albrecht Ruff, Heidenheim, Fed. Rep. of Germany

[73] Assignee: J. M. Voith, GmbH, Heidenheim, Fed. Rep. of Germany

[21] Appl. No.: 930,294

[22] Filed: Nov. 13, 1986

[30] Foreign Application Priority Data

Nov. 15, 1985 [DE] Fed. Rep. of Germany ..... 3540490

[51] Int. Cl.[4] ..... B65H 19/30

[52] U.S. Cl. ..... 242/56.4; 242/66

[58] Field of Search ..... 242/56 R, 55, 56.2, 242/56.4, 56.6, 56.9, 58, 58.6, 65, 66

[56] References Cited

U.S. PATENT DOCUMENTS 3,658,272 4/1972 Bennett et al. ..... 242/66
4,422,588 12/1983 Nowisch ..... 242/66 X
4,508,283 4/1985 Beisswanger ..... 242/56.4

FOREIGN PATENT DOCUMENTS 1217482 12/1970 United Kingdom .

*Primary Examiner*—David Werner
*Attorney, Agent, or Firm*—Albert L. Jeffers

[57] ABSTRACT

A winding machine for paper-core insertion is provided for the simultaneous, shaftless winding in two winding beds the strips of a web slit lengthwise. The machine has three support rollers generally arranged next to each other, and the web strips are alternately run into the winding beds. A winding frame with a core guide is associated with each edge of the wound rolls, which core guides have core grips. A transport device, positioned above the middle of the three support rolls, cooperates with an insertion assembly to transfer new paper cores into the respective winding beds. Alignment of all paper cores in unbroken sequence on the transport device ensures transfer of the paper cores of the proper width to the correct location. Each winding frame has an insertion device on either side of a separating plane defined by consecutive wound rolls. The insertion devices transport new paper cores to the appropriate core grips for transfer to the winding bed.

10 Claims, 3 Drawing Sheets

III
III
14
15
16
17
18
19
21
23
28
30
31
32
34
34
37
39
42
43
44
46
47
49 (50)
51
52
52
53
54
55
56
60
61'
61"
65

WINDING MACHINE FOR WINDING A WEB SLIT LENGTHWISE

BACKGROUND OF THE INVENTION

The invention broadly relates to a winding machine for simultaneously winding the strips of a web slit lengthwise into at least two winding rolls or reels without a shaft.

A winding machine is disclosed in German patent DE-OS No. 32 43 994, corresponding to U.S. Pat. No. 4,508,283. This patent teaches a machine with two insertion devices for new paper cores disposed parallel to each other above the middle support roll. The paper cores are positioned in the insertion devices from the front side of the support roll. Thereafter, the paper cores are transferred during a wound roll change-over into the respective winding bed by a pivoting movement of the two insertion devices. It is necessary to position the new paper cores precisely in the respective insertion devices as the cores must be correctly positioned in the winding bed for grasping by the grips of the corresponding reel ends. The two insertion devices require a certain amount of space above the center support roll.

SUMMARY OF THE INVENTION

The invention ensures that new paper cores are transferred into the appropriate winding bed at the correct position in the winding machine. The machine described is a winding machine for simultaneous, shaftless winding for strips of a web slit lengthwise into at least two wound rolls or reels. The machine has a frame, three support rollers with longitudinal axes mounted in the frame adjacent one another with their axes parallel. The middle roller and each adjacent side roller cooperate to define an upper wedge space therebetween which includes a winding bed for receipt of the web strips in alternate sequence. That is, the odd numbered webs or strips could be wound or rolled above the first outer roller and the even numbered strips could be wound or rolled above the second outer roller. An insertion apparatus or device for each wound roll is mounted on the frame generally above the middle roller and this apparatus provides a means to both eject a fully wound roll and replace the paper core for the next roll. The winding frames associated with the winding machine are mounted on the winding frame and are movable along the longitudinal axis parallel to the support rollers on a girder. These frames include core guides with grips for the ends of the paper cores which are adjustable to receive the various size web strips.

The process for production of the wound reels or rolls utilizing the above-described apparatus requires the paper cores for the wound rolls being in alignment on an elongated transport device generally located above the middle support roll and mounting or positioning fresh paper cores thereon; the insertion devices on the ejection apparatus are mounted above the winding bed and provide a core-grasping clamp to grip each paper core within the individual winding frame for each wound roll; thereafter during removal of a fully wound roll, the new paper core is positioned for receipt by the paper core guide grips and the grips introduce or move the new paper core for receipt of the slit web strips.

The structure provides an advantageous arrangement to introduce a new core while ejecting a fully wound reel. This core transfer structure requires a nominal or small space within the winding machine, therefore, the wound rolls or reels may be larger in maximum diameter. Further, during the wound roll change-over sequence, each paper core is securely grasped at both ends because of the axially precise alignment of rocking lever clamps for transfer to the grips of the corresponding winding frame. After insertion devices are pivoted over the corresponding winding bed, the paper core is grasped by the grips of the core guides and lowered into the winding bed. The new paper cores cannot move axially because of the guided transfer by the transport device into the winding bed. The winding frames are adjustable to accommodate varying strip widths and the grips associated with these winding frames will continue to cooperate with any size paper cores as these paper cores will be securely grasped on either end thereof by the respective core guide grips.

BRIEF DESCRIPTION OF THE DRAWINGS

In the figures of the drawing, like reference numerals identify like components, and in the drawing.

DETAILED DESCRIPTION OF THE INVENTION

Figure 1:
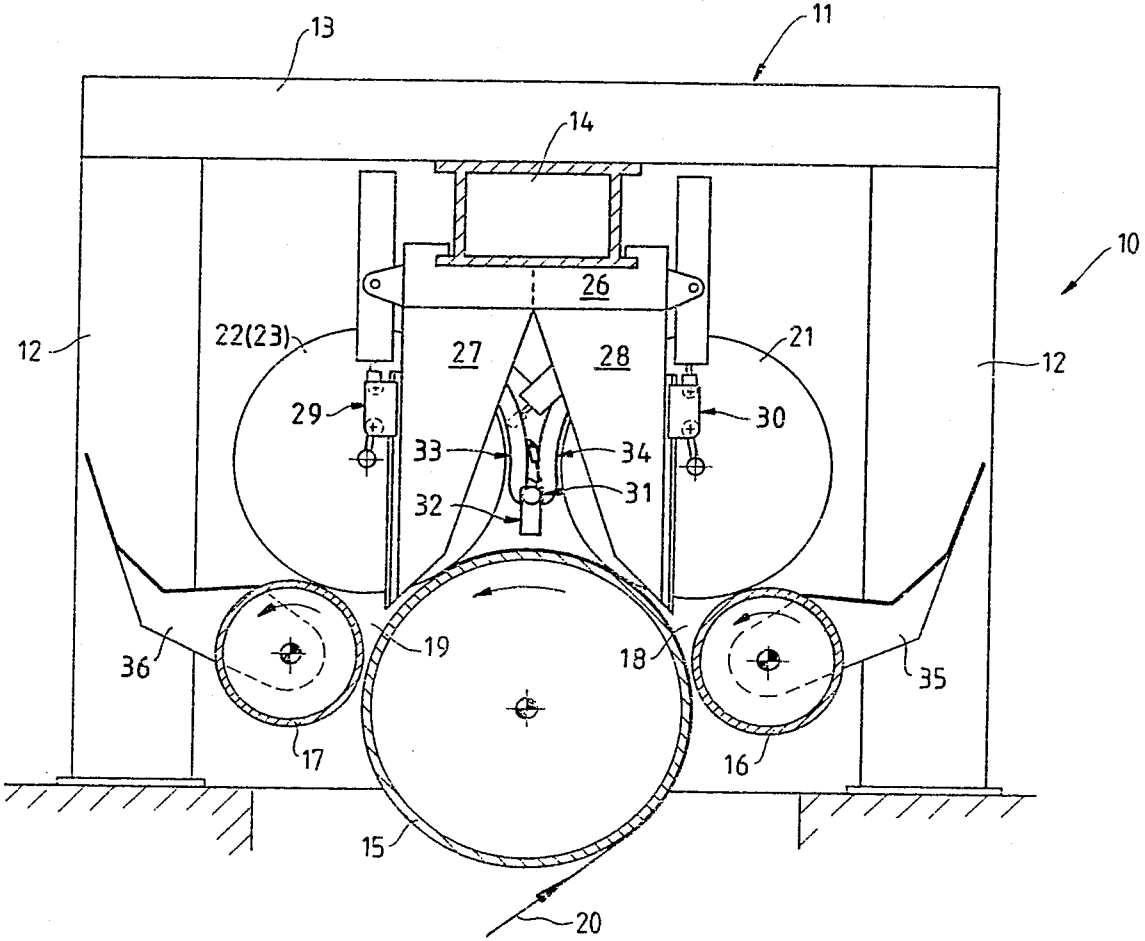
FIG. 1 is a winding machine in cross-section with three support rollers and a transport device and several insertion devices for new paper cores generally shown above the middle support roller.

In FIG. 1, a winding machine 10 has a machine frame 11 with uprights 12 arranged at the corners, which are connected by transoms or crossbeams 13. Transoms 13 are disposed on both sides of machine 10 and are connected in the center of the machine by a longitudinal girder 14. Machine frame 11 has three support rollers or rolls 15, 16 and 17 arranged in frame 11. These support rollers, that is middle roller 15, and outer support rollers 16 and 17 define or have longitudinal axes, which axes are parallel in the position of these rollers in machine frame 11. Each of the support rollers 15–17 cooperates with a drive mechanism, which is not illustrated herein. As shown in FIG. 1, the two outer support rollers 16 and 17 are at the same relative vertical height within machine frame 11, and have the same diameter, which is less or smaller than the diameter of the middle roller 15. The longitudinal axis of middle roller 15 lies at a lower vertical level as shown in FIG. 1, than that of the outer rollers. Middle roller 15 cooperates with each of the adjacent outer rollers to define therebetween an upper wedge space vertically displaced above these adjacent rollers, which define therein a winding bed in each of these upper wedge spaces. Thus, the outer support roller 16 and middle roller 15 define winding bed 18 while outer support roller 17 with middle roller 15 defines winding bed 19.

Figure 3:
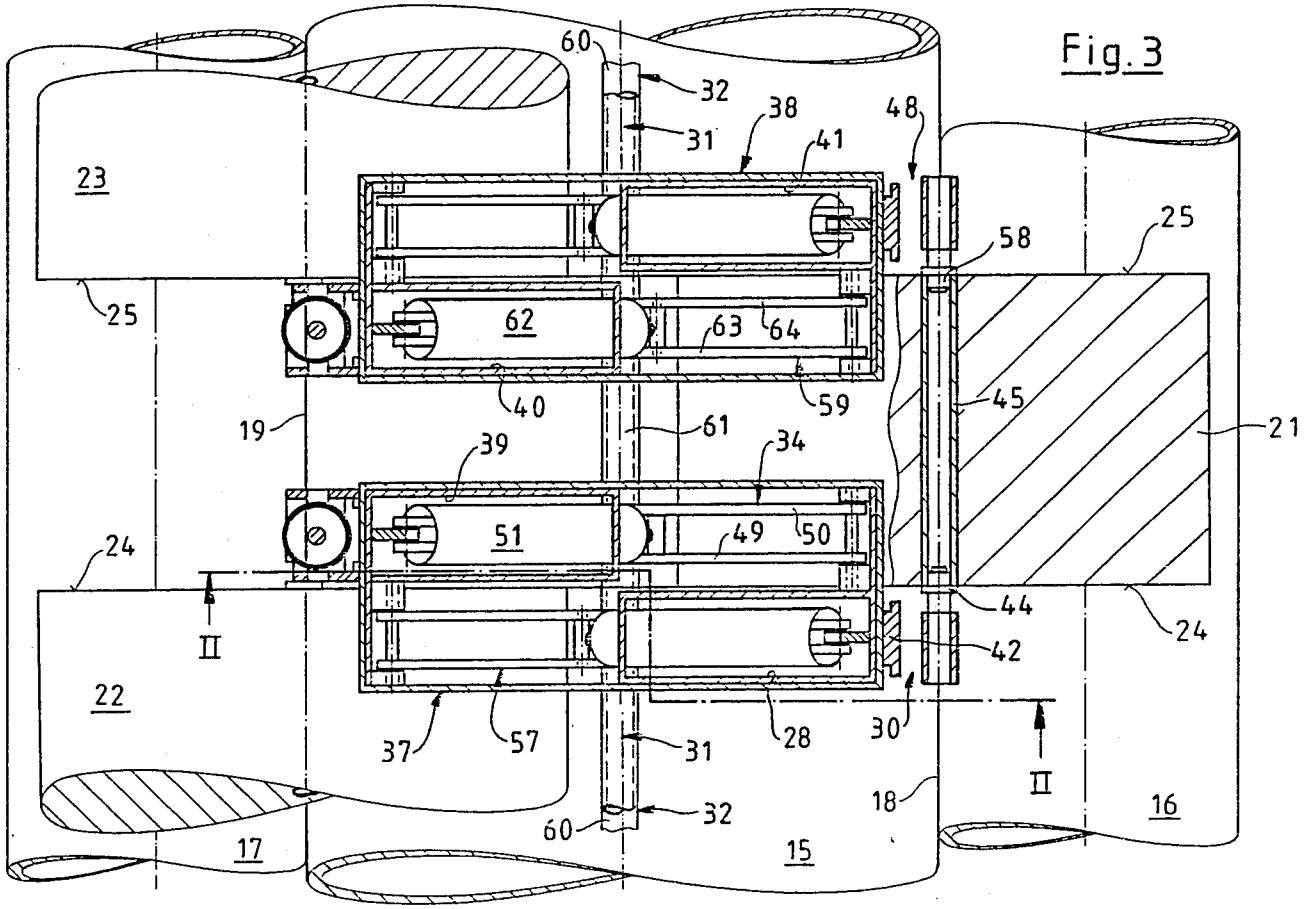
FIG. 3 is a sectional view through the machine along line III—III in FIG. 2.

The strips of a web 20 slit lengthwise in a slitting apparatus (not shown) are provided to winding machine 10 from below in FIG. 1. The strips of web 20 are in vertical alignment normal to the plane of the drawing and are wound around an arc segment of the middle support roller circumference. In winding bed 18 (counting from the front of the machine, that is the plane of the drawing) the first, third, fifth, etc., web strips are wound or rolled onto paper cores 61, while the second, fourth, etc., web strips are wound onto paper cores 31 in winding bed 19. In FIG. 3, the third web strip is wound into wound roll 21 in winding bed 18. The second web strip forms wound roll 22 in winding bed 19 and the fourth web strip forms wound roll 23 therein. As FIG. 3 shows, web strips alternately enter winding beds 18 and 19, therefore, winding rolls 21–23 in their respective winding bed define an axial space or gap corresponding to the width of the wound roll produced in the other winding bed. Wound roll sidewalls or corresponding front surfaces of wound rolls 21 and 22 are in alignment and in the case of wound rolls 21 and 22, they define a separating plane 24 between the respective web strips. Similarly, the other side wall or front surface of wound roll 21 aligns with the corresponding front surface or edge of wound roll 23 to define separating plane 25.

Winding frames 27 and 28 are mounted on longitudinal girder 14 in carriages 26 to guide wound rolls 21–23. Winding frames 27 and 28 have core guides 29 and 30, respectively, mounted thereon to engage the center of the wound rolls. When exchanging wound rolls 21–23 for new paper cores 61 and 31 to continue winding the web strips, a transport device 32 for paper cores 61 and 31 is arranged above middle support roller 15. Insertion apparatus 33 and 34, provided for individual winding frames 27 and 28, transfer new paper cores 61 and 31 into their appropriate winding bed 18 or 19 with core guides 29 and 30, respectively. Each outer support roller 16 and 17 is assigned a delivery device 35 or 36 for removal of wound rolls 21–23 expelled from winding beds 18 or 19 of machine 10. Winding frames 27 and 28, core guides 29 and 30, transport devices 32 and insertion devices 33 and 34 are described in greater detail below with particular reference to FIGS. 2 and 3.

In FIG. 3, guide carriages 37 and 38 are mounted on longitudinal girder 14 and are operable at separating plane 24 or 25, respectively, between the web strips. Guide carriages 37 and 38 can be longitudinally moved and secured on girder 14 to accommodate the varying widths of the web strips being wound. Each guide carriage 37 or 38 is provided with at least one winding frame projecting downward in FIGS. 1–3 toward the appropriate winding bed 18 or 19, respectively. Winding frames 28 and 39 are mounted on guide carriage 37. Winding frame 28 is positioned in front of separating plane 24 and winding frame 39 is behind separating plane 24 as related to the normal of the drawing plane. Winding frame 28 is operable with wound roll 21, and winding frame 39 operates with wound roll 22. Guide carriage 38 is provided with winding frames 40 and 41 which are operable with wound rolls 23 and 21, respectively, on the front and back sides of separating plane 25. A guide carriage (not shown) having only one winding frame, can be assigned to the outer front surfaces of the first and last wound rolls as it is apparent that there will be no oppositely displaced roll to cooperate to define a facing surface.

Winding frame 28 has a vertical track 42 open to winding bed 18 with a carriage 43 mounted and slidable on track 42, carriage 43 has a pivoting, suspended grip 44 which engages and retains a paper core 45 for winding roll 21 without a shaft. A thrust motor 46 (pneumatic or hydraulic cylinder type) with a piston rod 47 is mounted on guide carriage 37 above track 42 and piston rod 47 acts on carriage 43. The remaining winding frames and guide carriages of winding machine 10 are similarly equipped with tracks, carriages and motors. Thrust motor 46, track 42, carriage 43 and grip 44 form the essential components of core guide 30 mentioned above. The core guides operate in pairs and in this regard core guide 30 cooperates with core guide 48 at the rear sidewall of wound roll 21 to axially guide paper core 45 and the wound roll formed thereon with precise positioning in winding bed 18 during the winding operation.

On the back side of separating plane 24, insertion or injection assembly 34 is operable in winding frame 28 and has two congruent rocking levers 49 and 50. Rocking levers 49 and 50 are mounted on winding frame 28 within guide carriage 37, above winding bed 18 at a point just beyond the maximum roll diameter producible in winding machine 10. Rocking levers 49 and 50 project downward into the space above middle roller 15 and have a curvature generally following the maximum circumference of a wound roll, such as roll 21, but at a gap or distance separated therefrom. Rocking levers 49 and 50 are operable by a thrust motor 51 (pneumatic or hydraulic cylinder type) mounted on the opposite side of carriage 37 with a piston rod 52 coupled to and acting on the center section of rocking levers 49 and 50. At the lower or free end of rocking levers 49 and 50 are fitted a pincer-shaped clamp 53 with a first shank 54 securely attached to the end of the rocking lever. The other or second shank 55 of clamp 53 can be moved by means of thrust motor 56 (pneumatic cylinder) relative to the fixed shank 54. Rocking levers 49 and 50, clamps 53, and thrust motors 51 and 56 form the essential components of insertion and roll ejection device 34 for new paper cores 61 and 31.

Figure 2:
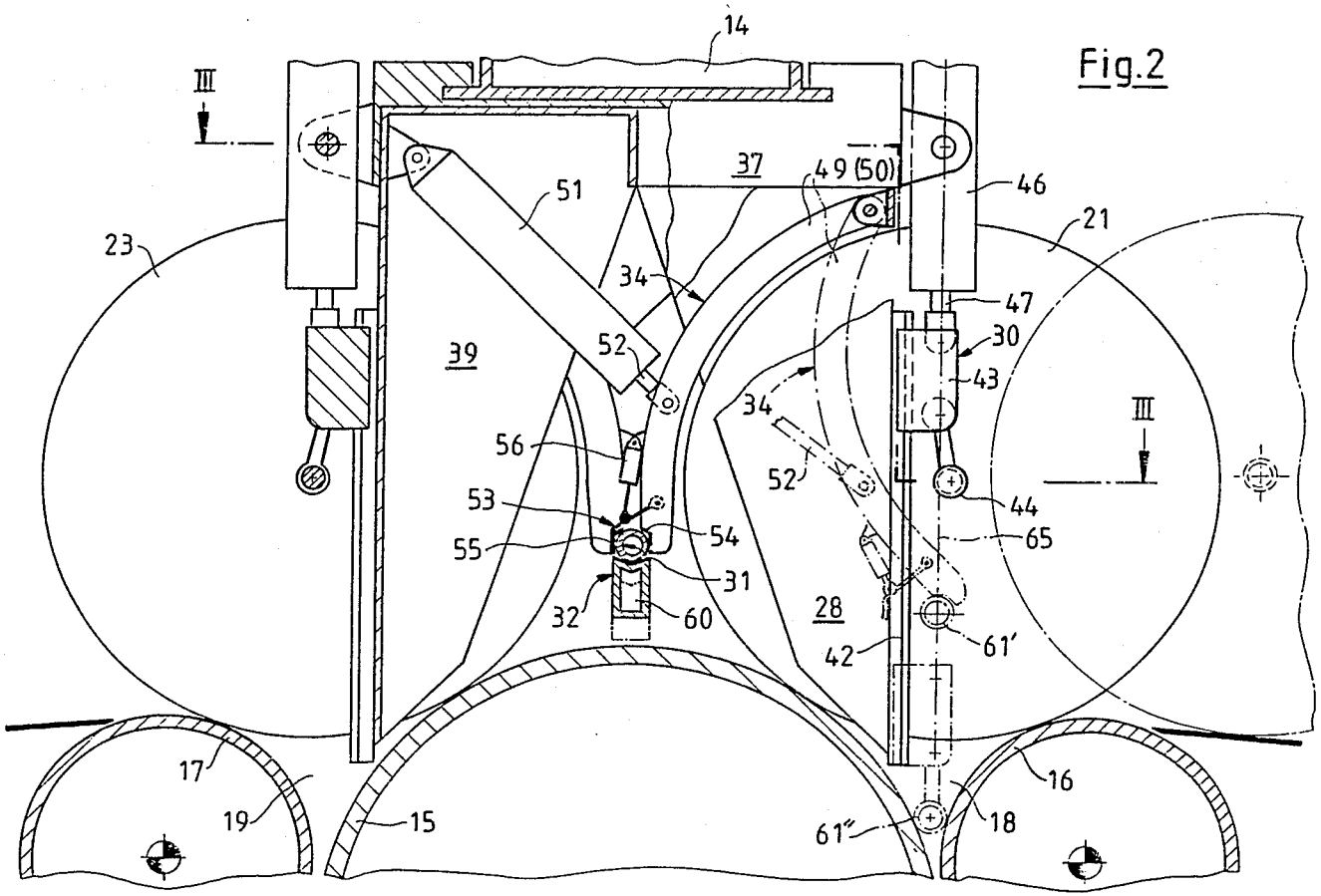
FIG. 2 is an enlarged cross-sectional view of the area above the winding beds of the machine along line II—II in FIG. 3.

Disregarding the guide carriages at the end surfaces of winding machine 10, each guide carriage associated with a separating plane also has two insertion devices 34 or 57, in FIGS. 2 and 3, apart from the two winding frames and diagonally opposite as shown in plan view of FIG. 3, which insertion devices are arranged alternately in relation to the separating planes. In the case of guide carriage 37, insertion device 34 is opposite winding frame 28 and in front of the front surface of wound roll 21 on the backside of separating plane 24. Accordingly, winding frame 39 and insertion device 57 are operable with wound roll 22. Only guide carriages assigned to the two edges of web 20 (i.e., the outside rolls) can be equipped with a winding frame and an insertion device.

The following structural components are operable with wound roll 21: winding frames 28 and 41 of guide carriages 37 and 38, respectively, extend on both sides of the front surfaces of wound roll 21 in separating.-planes 24 and 25; core guides 30 and 48 of winding frames 28 and 41 engage the ends of paper core 45 of wound roll 21 with grips 44 and 58. Within the width of wound roll 21 and adjacent its front surface, insertion device 34 of winding frame 28 extends toward the top of middle support roller 15. An insertion device 59 in winding frame 41 is positioned in front of separating plane 25 in a similar manner. Corresponding structural components are similarly associated with the remaining illustrated wound rolls 22 and 23.

As shown in FIG. 1, the transport device for new paper cores 61 and 31 is arranged directly above middle support roller 15 and parallel to its longitudinal axis. Transport device 32 has a beam 60 with a groove on its top side to receive paper core 61 and 31. Transport device 32 has a drive, not shown, to vertically move beam 60 in winding machine 10 from its position shown by dot-dash lines in FIG. 2 into the position illustrated by solid lines.

Full winding reels or wound rolls are exchanged for new paper cores as follows: during the winding operation new paper cores 61 and 31 with lengths the width of web strips to be wound and in aligned sequence, are pushed from the front of winding machine 10 onto beam 60 in its lower position. A lug (not shown) in alignment with the plane of the edge of web 20 is turned away from the front and ensures the front surfaces of paper cores 61 and 31, pushing against one another, align precisely with the respective separating planes 24 and 25 of the web strips. New paper cores 61 and 31 are provided with a sized, adherent streak for the start or starting edge of the new web strip, which start adheres to the paper core at the beginning of the winding operation. As the rolls become fully wound, beam 60 is elevated and cores 61 and 31 enter open clamps 53 of respective insertion devices 34, 57 and 59. Clamps 53 are closed by thrust motors 56 to grasp new paper cores 61 and 31. Beam 60 is lowered into its position over roller 15. Alternatively, new paper cores 61 and 31 can be pushed onto beam 60 in its upper position (solid lines). After the paper cores are grasped by clamp 53, beam 60 may again be lowered into its lower position.

After attainment of the desired diameter of wound rolls 21–23, support rollers 15–17 are stopped. Grips 44 and 58 of core guides 29, 30 and 48 are withdrawn from paper core 45 and the corresponding wound reel or roll is released from associated core guides 29, 30 or 48. The wound rolls 21–23 are simultaneously ejected from winding beds 18 and 19 and removed from machine 10 by delivery devices 35 or 36. As wound rolls are separated from the web strips, the new web strip start is held in the respective winding bed 18 or 19 by a means known in the art but not shown.

Insertion of a new paper core will be described utilizing paper core 61 inserted into winding bed 18 and with reference to the position of wound roll 21: as wound roll 21 is being ejected, thrust motors 51 and 62 of insertion devices 34 and 49 simultaneously pivot the rocking levers 49, 50 and 63, 64 to bring the longitudinal axis of new paper core 61, grasped by clamps 53 of insertion devices 34 and 59, to position 61' (FIG. 2) which coincides with a path 65 for grips 44 and 58 suspended from carriages 43 of core guides 30 and 48. In position 61', carriages 43 of core guides 30 and 48 are moved vertically down by thrust motor 46 toward winding bed 18. When the axis of paper core 61 in position 61' and the axes of grips 44 and 58 coincide, the grips enter the core ends. After paper core 61 is held by grips 44 and 58, clamps 53 of insertion devices 34 and 59 open. Core guides 30 and 48 lower new paper core 61 to web strip start in winding bed 18 (position 61'') and insertion devices 34 and 59 return to their initial or reference position. Correspondingly, remaining paper cores 31 of a core set are simultaneously conveyed to their respective winding beds 18 and 19. Machine 10 is again ready to resume winding operations.

While only particular embodiments of the present invention have been shown and described, it is manifest that these are in no way limiting on the scope of the invention described and claimed herein.

What is claimed is:

1. A winding machine for simultaneously and shaftlessly winding strips of a lengthwise-slit web into at least two rolls, each roll wound on a corresponding paper core, said winding machine comprising:

a machine frame;

three support rollers, each having a longitudinal axis, mounted on said machine frame adjacent one another with mutually parallel axes, one of said support rollers constituting a middle support roller with the other two of said support rollers disposed on opposite side of the middle support roller and constituting outer support rollers, the middle support roller cooperating with each adjacent outer support roller to define therebetween an upper wedge-shaped space constituting a winding bed;

an elongate transport device mounted on said machine frame above the middle support roller parallel to the axis thereof and having means for axially receiving axially aligned paper cores;

a pair of winding frames associated with each strip and corresponding paper core, mounted on said machine frame and movable parallel to the axes of said support rollers, said pair of winding frames including core guides having grip means for gripping the ends of the corresponding paper core and moving the paper core to a winding bed;

an insertion device mounted on each of said pair of winding frames above the middle support roller said insertion device including a rocking lever having a core-grasping clamp means for grasping a corresponding paper core located on said elongate transport device and delivering the paper core into the grip means of the winding frame prior to release of the paper core by the clamp means.

2. A winding machine according to claim 1, in which the rocking lever of said insertion device is mounted on the respective winding frame at a point just above the maximum diameter of the wound roll producible in said winding machine, which rocking level has a curvature following the maximum circumference of said wound roll but supported at a distance therefrom.

3. A winding machine according to claim 2, in which said transport device for said paper cores is operable to move a respective paper core into the core-grasping clamp means of the rocking lever.

4. A winding machine according to claim 2, further including a longitudinal girder mounted on said machine frame generally above and parallel to the axis of the middle support roller, a guide carriage mounted on and slidable between secured positions on said girder, each of the winding frames is secured to a single guide carriage and is arranged on either side of a separating plane defined between the edges of consecutive web strips.

5. A winding machine according to claim 1, in which said transport device for said paper cores is operable to move a respective paper core into the core-grasping clamp means of the rocking lever.

6. A winding machine according to claim 5, further including a longitudinal girder mounted on said machine frame generally above and parallel to the axis of the middle support roller, a guide carriage mounted on and slidable between secured positions on said girder, each of the winding frames is secured to a single guide carriage and is arranged on either side of a separating plane defined between the edges of consecutive web strips.

7. A winding machine according to claim 1, further including a longitudinal girder mounted on said machine frame generally above and parallel to the axis of the middle support roller, a guide carriage mounted on and slidable between secured positions on said girder, each of the winding frames secured to a single guide carriage and arranged on either side of a separating plane defined between the edges of consecutive web strips.

8. A winding machine for simultaneous, shaftless winding of adjacent strips from a web slit lengthwide into at least two adjacent wound rolls cooperating to a defined a separating plane therebetween, each roll wound on a paper core, each of said wound rolls having a first edge and a second edge, said winding machine comprising:

a machine frame;

a first outer support roller, a second outer support roller and a middle support roller, said support rollers mounted in said machine frame and having peripheries and longitudinal axes, which axes are parallel;

said middle support roller cooperating with each of said first and second outer support rollers to define between the respective peripheries thereof a first winding bed and a second winding bed, respectively, said winding beds alternately receiving adjacent strips;

a winding frame for each of said wound rolls first edges and second edges, which winding frames are longitudinally movable in said machine frame parallel to said support roller axes, said winding frames including core guides with grips for the ends of a paper core;

a paper core insertion device for each of said wound rolls, which insertion devices are operably mounted in one of said winding frames, each of said insertion devices having at least one rocking level with a paper-core grasping clamp;

said rocking levers pivotably mounted on said winding frames above a winding bed for each of said wound rolls, at least one rocking lever at each of said wound roll edges on a side of said separating plane;

an elongate transport device generally disposed above the middle support roller, on which said paper cores with a length equal to the wound roll width are sequentially aligned, having means for paper core transfer to said core-grasping clamps of said rocking levers of each of said wound rolls, which rocking levers pivot to align said paper cores with said core guide grips prior to release of said paper cores by said clamps, said core guide grips securing and moving said paper cores to the respective winding bed of said wound roll.

9. A winding machine according to claim 8 wherein said rocking levers of said insertion devices have a curvature at least as great as the circumfernece of the largest diameter wound roll producible on said winding mahcine but are separated from said wound rolls at an inoperative position by a predetermined separating distance, said rocking levers pivotably mounted on winding frames at a location outside the largest diameter of said wound rolls.

10. A winding machine according to claim 8 wherein said machine frame further includes a longiudinal girder mounted on said machine frmae parallel to and above said middle support roller axis and said winding beds;

a guide carriage for each of said winding frames, which guide carriages are mounted on and slidable between secured positions on said longitudinal girder;

each of said winding frames secured to a guide carriage and arranged to operate on one side of said separating plane.

* * * * *

UNITED STATES PATENT AND TRADEMARK OFFICE

CERTIFICATE OF CORRECTION

PATENT NO. : 4,749,140

DATED : June 7, 1988

INVENTOR(S) : Hans-Albrecht Ruff

It is certified that error appears in the above-identified patent and that said Letters Patent is hereby corrected as shown below:

Claim 8, Col. 7, line 7, change "a define" to --define--'

Claim 9, Col. 8, line 17, change "circumfernece" to --circumference--;

Claim 9, Col. 8, line 19, change "mahcine" to --machine--;

Claim 10, Col. 8, line 26, change "longiudinal" to --longitudinal--;

Claim 10, Col. 8, line 27, change "frmae" to --frame--.

Signed and Sealed this

Eighth Day of November, 1988

*Attest:*

DONALD J. QUIGG

*Attesting Officer*

*Commissioner of Patents and Trademarks*